US007405351B2

(12) United States Patent
Maeng

(10) Patent No.: US 7,405,351 B2
(45) Date of Patent: Jul. 29, 2008

(54) EVENT ACTIVATED WIND CHIME SYSTEM AND METHOD OF USE

(75) Inventor: Joon Maeng, Austin, TX (US)

(73) Assignee: Strauss Acquistions, L.L.C., Wilmington, DE (US)

( * ) Notice: Subject to any disclaimer, the term of this patent is extended or adjusted under 35 U.S.C. 154(b) by 151 days.

(21) Appl. No.: 11/406,931

(22) Filed: Apr. 19, 2006

(65) Prior Publication Data

US 2007/0175315 A1 Aug. 2, 2007

Related U.S. Application Data

(60) Provisional application No. 60/764,062, filed on Feb. 1, 2006.

(51) Int. Cl.
*G10D 3/08* (2006.01)

(52) U.S. Cl. ..... 84/404; 84/402; 84/405; 84/410

(58) Field of Classification Search ..... None
See application file for complete search history.

(56) References Cited

U.S. PATENT DOCUMENTS

| | | | | |
|---|---|---|---|---|
| 5,072,208 A | | 12/1991 | Christensen | |
| 5,208,578 A | * | 5/1993 | Tury et al. | 340/392.2 |
| 5,648,624 A | | 7/1997 | Smith | |
| 5,744,736 A | * | 4/1998 | Chang | 84/402 |
| 5,831,516 A | | 11/1998 | Jennings | |
| 5,959,527 A | * | 9/1999 | Beder et al. | 340/392.4 |
| 6,103,962 A | | 8/2000 | Kirchner | |
| 6,124,539 A | | 9/2000 | Barnes, III | |
| 6,124,782 A | * | 9/2000 | Kraft, Sr. | 340/393.2 |
| 6,166,310 A | | 12/2000 | Carter | |
| 6,417,763 B1 | * | 7/2002 | Petruzzi | 340/392.1 |
| 6,441,284 B1 | | 8/2002 | Greene | |
| 6,559,367 B1 | * | 5/2003 | Yiu | 84/405 |
| 2004/0083876 A1 | * | 5/2004 | Maegli et al. | 84/410 |
| 2005/0145088 A1 | * | 7/2005 | Tse | 84/103 |
| 2007/0214879 A1 | * | 9/2007 | Werbin | 73/170.01 |

* cited by examiner

*Primary Examiner*—Marlon T Fletcher
(74) *Attorney, Agent, or Firm*—McDonnell Boehnen Hulbert & Berghoff LLP

(57) ABSTRACT

An event activated wind chime system and method of use are disclosed. In one form, an event activated wind chime system includes a wind chime assembly including at least one wind chime element proximally located to a striker operable to contact the wind chime element to output a wind chime sound. The system further includes an event detector operably coupled to a striker activation processor provided in association with the striker. The event detector is operable to detect an event and provide an input to the striker activation processor to produce the wind chime sound using the striker in response to the detected event.

31 Claims, 7 Drawing Sheets

EVENT ACTIVATED WIND CHIME SYSTEM AND METHOD OF USE

CROSS REFERENCE TO RELATED APPLICATION

This application claims priority to U.S. Provisional Patent Application entitled "Method and Apparatus for Making Wind Chime Work Without Wind" having application Ser. No. 60/764,062 and filed on Feb. 1, 2006.

FIELD OF THE DISCLOSURE

The present invention relates to wind chimes, and more particular, to an event activated wind chime system and method of use.

BACKGROUND

Electric door chimes and call bells are widely used at homes, stores and offices to inform residents or businesses that a visitor has arrived. For example, a conventional doorbell produces a sound when a visitor presses a button or opens a door. Upon an occupant hearing a doorbell sound, the occupant may answer a door accordingly.

Some limitations of conventional doorbells include being able to produce very simple sounds that may be annoying and/or are too loud for quite places. Although effective, visitors or residents may be startled by the sound of a doorbell that is too loud. In some forms, conventional doorbells or buzzers are not visually appealing or portable. For example, some conventional doorbells or doorbell chimes are placed within plastic housings and mounted to a wall that is usually out of plain site.

Conventional call bells in offices and stores are manually operated. For example, a visitor must press a call bell to request service if servers or attendants are not present. In some instances, electronic doorbells use magnetic devices installed along side of a door that are configured to detect when a door is opened and activate a doorbell, call bell or alarm. However, due to various shapes of doors and doors frames, installing such devices can be difficult. Additionally, such devices may employ electronic sound generators to produce various sounds or alarms. However, the audio range of such devices is limited and cannot truly duplicate actual wind chimes sounds. As such, what is needed is a door chime or warning system having improvement in sound quality, visual appearance, portability and activation control for automatically notifying a user of a visitor or an occurrence of a specific event.

SUMMARY OF THE INVENTION

Several embodiments of an event activated wind chime system and method of use are disclosed. According to one aspect of the invention, an event activated wind chime system includes a wind chime assembly including at least one wind chime element proximally located to a striker operable to contact the wind chime element to output a wind chime sound. The system further includes an event detector operably coupled to a striker activation processor provided in association with the striker. The event detector is operable to detect an event and provide an input to the striker activation processor to produce the wind chime sound using the striker in response to the detected event.

According to another aspect of the invention, an event activated wind chime system includes a wind chime assembly having at least one wind chime element proximally located to a striker operable to contact the at least one wind chime element to output a wind chime sound. The system further includes a striker activation processor coupled to a control circuit operable to control an output of the striker activation processor to produce an output sufficient to move the striker to contact the at least one wind chime element. The system further includes an event detector operably associated with the striker activation processor and the event detector is operable to detect an event and provide an input to the striker activation processor to produce the wind chime sound.

According to a further aspect of the invention, a motion activated wind chime system is disclosed. The system includes a wind chime assembly including at least one wind chime element proximally located to a striker operable to contact the at least one wind chime element to output a wind chime sound. The system further includes a motion detector operably associated with a striker activation processor coupled to a control circuit operable to provide a motion detection interval and a range detection distance. The motion detector is operable to detect motion based on the range detection distance and provide an input to the striker activation processor to produce the audio wind chime sound based on the motion detection interval.

It is an object of the invention to provide an automatic call bell using an event activated wind chime system to output a wind chime sound upon detecting a visitor.

It is another object of the invention to provide a visually appealing event activated wind chime system to produce wind chime sounds in the absence of wind.

It is a further object of the invention to provide a method of alerting when motion is detected using a wind chime system in the absence of wind.

It is another object of the invention to provide a wind chime system that outputs a wind chime sound upon detecting a computer-based event.

It is a further object of the invention to provide a remote activated wind chime system that detects events in a remote location and provides references to a detected event for producing a wind chime sound.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1:
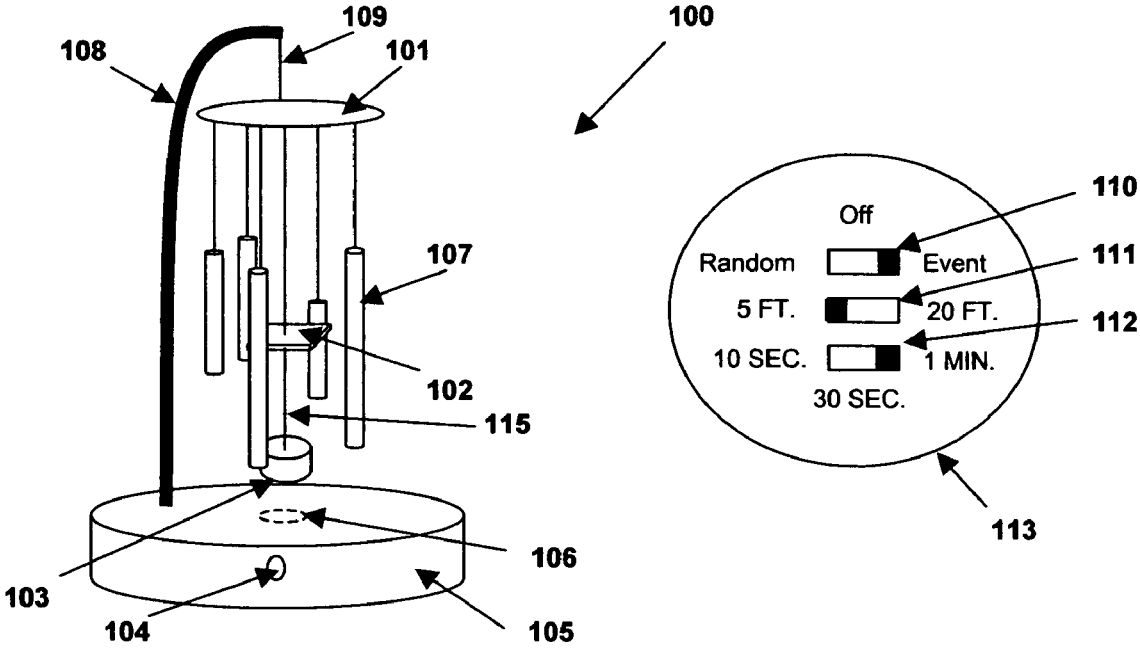
FIG. 1 illustrates an event activated wind chime system and control unit in accordance with one aspect of the present invention.

FIG. 1 illustrates an event activated a wind chime system and control unit in accordance with one aspect of the present invention. An event activated wind chime system, illustrated generally at 100, includes a hammer or striker 102 coupled to a top portion and centered to wind chime assembly 101 using a string or cable 109. Wind chime assembly 101 is coupled to frame or hanger 108 operable to suspend wind chime assembly 101 using string 109. Base 105 provides support for hanger 108 and further includes a motion sensor 104 operable to detect motion. Other types of sensors may also be used to detect an event such as a wind sensor, a microphone, a sensor, a door bell activator, or any other type of sensor that may provide an event for activating event activated wind chime system 100.

Wind chime assembly 101 includes a plurality of wind chime elements 107 spaced around striker 102 in a circular manner. Other types or forms of wind chime and wind chime assemblies may be provided as wind chime assembly 101. For example, wind chime assembly 101 may include a single element or piece of material that may be activated by a striker contacting a single element. In another embodiment, wind chime elements 107 may include a 'gong', circular, or acoustic symbol shaped wind chime element. In another embodiment, wind chime elements 107 may include a bell or series of bells. In one form, wind chime elements 107 may include plural tubes having various diameters may be used to produce wind chime sounds. Additionally, various shapes and sizes of wind chime assemblies may be used. For example, wind chime assembly 101 may be included a triangular, tiered, etc. As such, wind chime assembly 101 is not limited to a circular wind chime assembly as various types and styles of wind chimes may be employed.

Event activated event activated wind chime system 100 further includes a striker activator 103 coupled below striker 102 using string or cable 115. Striker activator 103 includes a permanent magnet located proximal to an electromagnetic activation region 106 operable to activate and repel striker activator 103. For example, striker activator 103 includes the same polarity produced by electromagnetic activation region 106 thereby repelling striker activator 103 when in use. Electromagnets and activation or production of electromagnetic fields are well known in art. Base 105 further includes input controls provided along bottom 113 of base 105 for programming operation of event activated wind chime system 100. Controls include an operating mode selector 110 to allow a user to select a random operating mode, an event operating mode, and an 'OFF' mode. Event activated wind chime system 100 further includes a range selector 111 to allow a user to control how far motion sensor 104 detects motion (i.e. five (5) feet, ten (10) feet, etc.). Event activated wind chime system 100 further includes an activation interval selector 112 for selecting an interval (i.e. ten (10) seconds, thirty (30) seconds, one (1) minute, etc.) to prevent continuous activation.

During operation, when operating mode selector 110 is placed in the 'event' mode, event activated wind chime system 100 is activated by detecting an event. For example, if motion sensor 104 detects motion, electromagnet activation region 106 is activated causing striker 103 to move. In one form, various other operating characteristics or parameters are considered prior to activating electromagnetic activation region 106. For example, event activated wind chime system 100 may be programmed to allow motion sensor 104 to detect motion at a specific range using range selector 11 1. For example, when range selector is placed in the five (5) feet position, motion sensor 104 may not detect motion greater than five feet away. As such, when motion is detected within five (5) feet of event activated wind chime system 100, wind chime system is activated using a striker activation processor (shown below) and electromagnet activation region 106 is activated causing striker activator 103 to move striker 102 to contact chime elements 107 for pre-determined duration (e.g., 5 seconds)

Although event activated wind chime system 100 includes a motion sensor 104 for detecting motion when placed in event mode, other types of events may also be sensed. For example, instead of, or in addition to, motion sensor 104, event activated wind chime system 100 may be provided in association with other sensors including light sensors, wind sensors, or other various remote sensors which may detect an event and provide an input for activating event activated wind chime system 100 when paced in an event operating mode. Additionally, wind chimes system 100 may be placed at the entrance of stores and offices or in the kitchen at home to use a sound sculpture. When an individual passes by, event activated wind chime system 100 produces a pleasurable wind chime sound for pre-determined duration (e.g., 5 seconds). In one form, motion sensor 104 may be an infrared sensor, an ultrasonic sensor, or other type of sensor, which detects movement. In other embodiment, the motion sensor 104 include a light sensor that may detect changing light intensity as an object passes in front of motion sensor 104.

In one form, when event activated wind chime 100 is set to the 'event mode' and the interval selector 112 is placed in the ten (10) second position, event activated wind chime system 100 is not responsive to any events detected for a period of ten (10) seconds after detecting a first event. In this manner, if a visitor is moving continuously in front of event activated wind chime system 100 after it was activated, event activated wind chime system 100 does not produce sounds continuously. Event activated wind chime system 100 activates the striker again only if a second event or motion is detected after no event or motion is detected for ten (10) seconds or more since it is activated by a first event or motion.

In one embodiment, wind chime system 110 may be placed in a random operating mode instead of an event operating mode. In a random operating mode, electromagnet activation region 106 is energized such that the polarity of electromagnet 105 is the same as striker activator 103 and striker activator 103 moves away from electromagnet activation region 106. Electromagnet activation region 106 may be periodically activated for a predetermined period of time causing striker activator 103 to sway or move striker 102 to contact chime elements 107 and produces a wind chime sound. For example, electromagnet activation region 106 may be activated for one (1) second and deactivated for one (1) second. The activation and deactivation period may repeat several times (e.g., five (5) times, ten (10) times, etc.).

Figure 2:
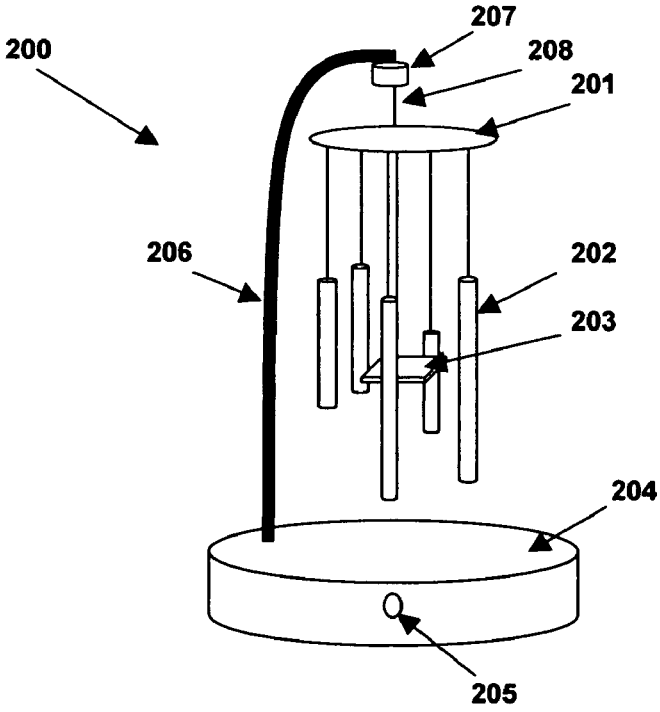
FIG. 2 illustrates an event activated wind chime system incorporating a rotational control unit according to another aspect of the invention.

FIG. 2 illustrates an event activated wind chime system incorporating a rotational control unit according to another aspect of the invention. Event activated wind chime system 200 includes a wind chime assembly 201 having chime elements 202 and a striker 203 placed proximal to chime elements 202 for contacting chime elements 202 to produce a wind chime sound. Wind chime system 200 further includes a hanger 206 coupled to a base 204 for supporting chime assembly 201. Wind chime assembly 201 is coupled to hanger 206 via string or cable 208 coupled to striker activation motor 207 operable to move wind chime assembly 201 to produce a wind chime sound. Striker activation motor 207 is coupled to hanger 206 and is powered by base 204 using electrical conductors provided within hanger 206 (not expressly shown). Event activated wind chime system 200 may include controls similar to controls 110, 111, 112 of event activated event activated wind chime system 100 illustrated in FIG. 1. In one form, event activated wind chime system 200 includes a motion sensor 205 for detecting motion and activating striker activation motor 207. For example, base 204 houses electronics (not expressly shown) for sensing motion and controller activation of striker activation motor 207. When a visitor or person approaches event activated wind chime system 200, motion sensor 205 detects movement and activates striker activation motor 207 to move wind chime assembly 201 and produce a wind chime sound. Other activation methods may also be used to move wind chime assembly 201.

Figure 3:
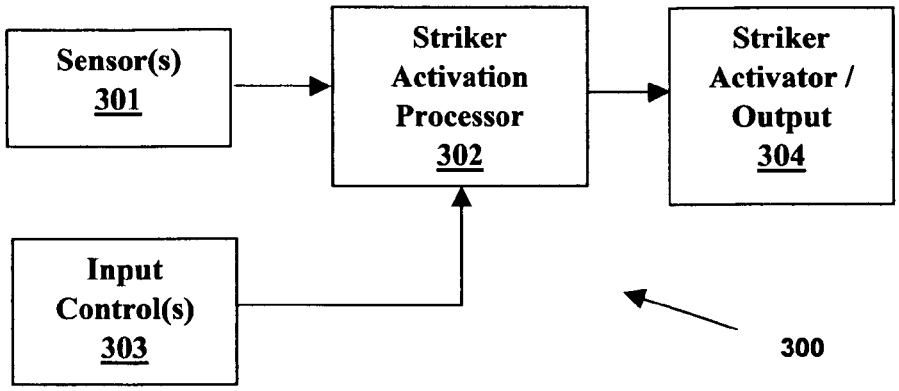
FIG. 3 illustrates a functional block diagram of an event activated wind chime system according to one aspect of the invention.

FIG. 3 illustrates a functional block diagram of an event activated wind chime system according to one aspect of the invention. A block diagram of an event activated wind chime system, illustrated generally at 300, includes a sensor 301, input control(s) 303, striker activation processor 302, and a striker activator/output 304. Sensor 301 may include various types of sensors for sensing movement including infrared motion sensors, light sensors, ultrasonic sensors, or various other types of sensors. Input control(s) 303 include one or more input switches, similar to input selectors 110, 111, 112 of FIG. 1 for enabling a user to control operating characteristics of event activated wind chime system 300. Input controls(s) 303 provide one or more inputs to striker activation processor 302 and may control one or more operating modes. Striker activation processor 302 receives inputs from sensor(s) 301 and input control(s) 303 to produce an output for striker activator/output 304. For example, striker activator/output 304 may be operable to cause a striker provided in association with a wind chime assembly to contact a chime element to produce a wind chime sound. A striker activator may include various types of activators including, but not limited to, an electromagnet, an electric motor, an electric fan, a striker coupled to a wind sail having an internal fan such as wind sails 1000 and 1010 illustrated in FIGS. 10A and 10B, or any other type of striker activator that may be employed to produce a wind chime sound when an event is detected. In one form, striker activator/output 304 may include various other outputs such as a light assembly or lamp, a speaker operable to output a pre-recorded messages such as "Welcome" or various other outputs. In one embodiment, striker activator / output 304 may output prerecorded alarm sounds in addition to, or in place of, a wind chime sound.

In another embodiment, event activated wind chime system 300 may include a control input 303 for placing event activated wind chime system 300 in an alarm mode or a chime mode. While in a chime mode, event activated wind chime system 300 operates to output wind chime sound. When in an alarm mode, event activated wind chime system 300 produces a loud alarm when sensor 301 detects movement. For example, a user may set event activated wind chime system 300 to a chime operating mode during the day hours or business hours. When a business closes, a user may switches an input control(s) 303 to an alarm mode. In one form, event activated wind chime system 300 may be switched to an alarm mode, and the alarm mode may be activated after a predetermined period of time elapses (e.g., five (5) minutes) allowing a user to leave a location or premises without activating event activated wind chime system 300. In another embodiment, input control(s) 303 may include an interface to program a time of day to activate an alarm mode. In another form, sensor(s) 301 may include a light sensor that sets an operating mode to an alarm mode when a light is turned off or daylight is no longer sensed.

Figure 4:
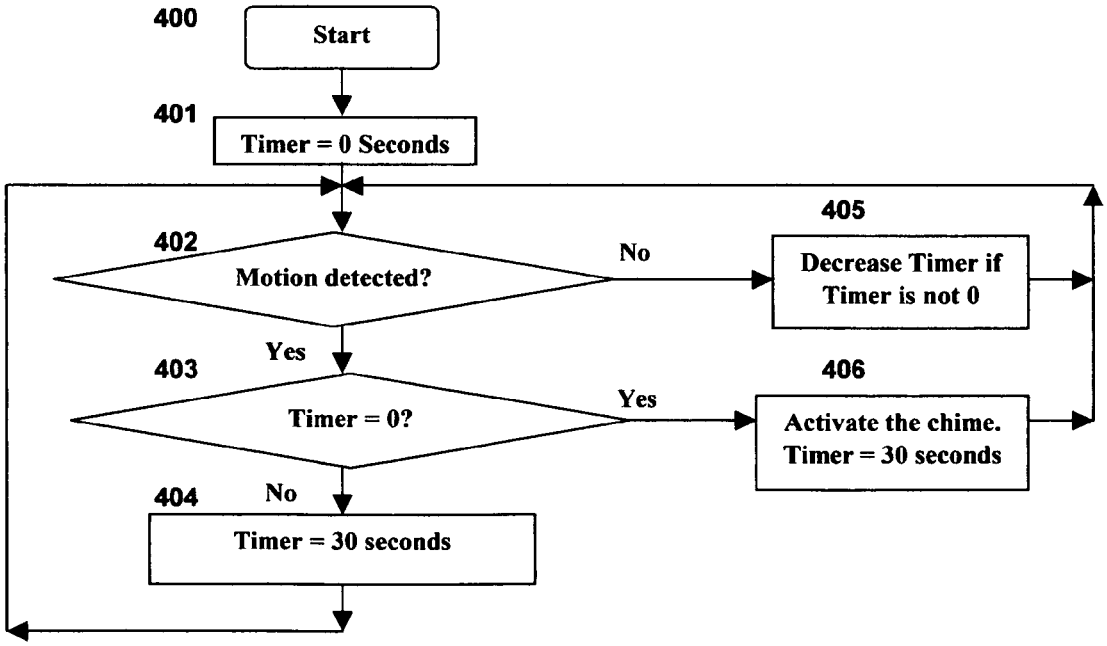
FIG. 4 illustrates a flow diagram of a method for activating a wind chime system in response to detecting motion according to one aspect of the invention.

FIG. 4 illustrates a flow diagram of a method for activating a wind chime system in response to detecting motion according to one aspect of the invention. The method may be employed by event activated wind chime system 100 illustrated in FIG. 1, event activated wind chime system 300 illustrated in FIG. 3 or any other type of system or device disclosed herein or other systems or devices operable to employ the method of FIG. 4 to provide a wind chime sound.

The method begins generally at step 400. At step 401 a timer is set to zero (0) seconds and if motion is detected at 402, the method proceeds to step 403 to determine if the timer is set to zero (0) seconds. In other embodiments, the timer may be set to various other intervals. For example, event activated wind chime system 100 may set a timer interval based on selection of interval selector 112 illustrated in FIG. 1 and the timer may be modified to increase or decrease based on a selection mode of interval selector 112.

If at step 402, motion is not detected, the timer is decreased if the timer is not already zero (0) seconds. If at step 402, motion is detected, the method proceeds to step 403 and determines if the timer is at zero (0) seconds. If the timer is at zero (0) seconds, the method proceeds to step 406 and activates or outputs a wind chime sound. The timer is reset to thirty (30) seconds and the method proceeds to step 402. If at step 403 the timer is not equal to zero (0) seconds, the method proceeds to step 404 and the timer is set to thirty (30) seconds. The method then repeats at step 402. As such, a wind chime system employing the method of FIG. 4 may disable outputting a wind chime sound until a new event is detected after the timer expires. If a new motion is detected before the timer expires, the timer is reset to the time chosen by interval selector 112 and the timer begins counting down at steps 402 and 405 if motion is not detected.

Figure 5:
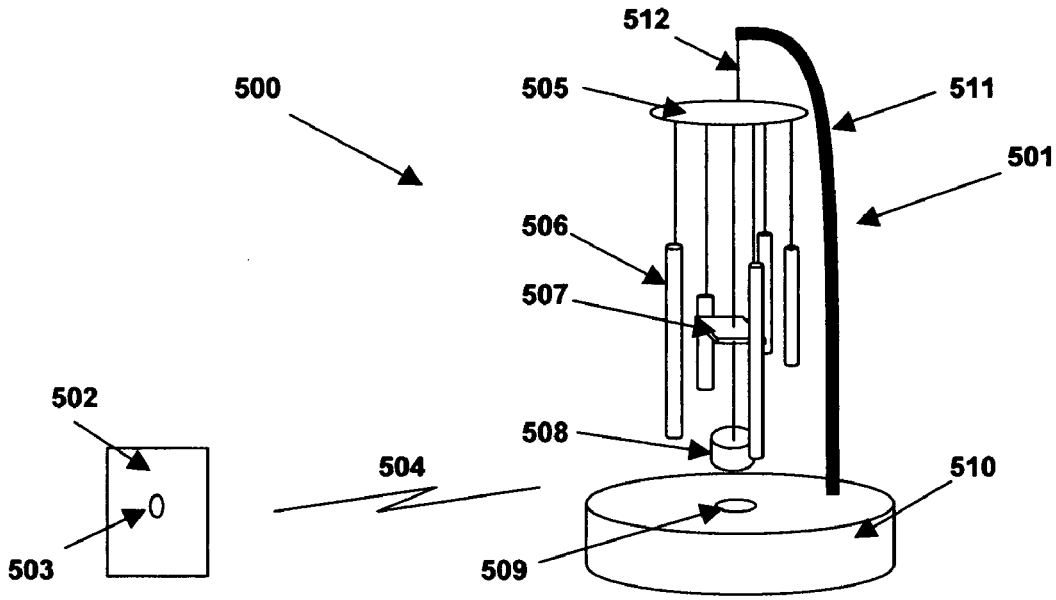
FIG. 5 illustrates a remote activated wind chime system according to one aspect of the invention.

FIG. 5 illustrates a remote activated wind chime system according to one aspect of the invention. Remote activated wind chime system, illustrated generally at 500, includes a remote event detector 502 having a sensor 503 operable to detect an event for outputting a wind chime sound. Remote event detector 502 may include a call button or bell activator, a motion sensor, a wind sensor to detect a change in a wind produced outdoors, or any other type of remote sensor operable to detect a specific event for producing a wind chime sound.

Remote activated wind chime system 500 further includes a wind chime unit 501 operable to output a wind chimes sound in response to a remote event. Wind chime unit 501 includes a wind chime assembly 505 having chime elements 506 and a striker positioned proximal to chime elements 506. A striker activator 508 is positioned below striker 507 and is responsive to an electromagnet provided along electromagnetic activation region 509 within housing 510. Wind chime unit 501 further includes a hanger 511 for supporting wind chime assembly 505 using string or cable 512.

Remote event detector 502 further includes a wireless transmitter for transmitting a signal in response to detecting an event. Additionally, wind chime unit 501 includes a wireless receiver for receiving signals transmitted by remote event detector 502 for outputting a wind chime sound. For example, when an event is detected by sensor 503, remote event detector 502 communicates a wireless signal to wind chime unit 501 and wind chime unit 501 activates electromagnetic activation region 509 causing striker activator 508 to move striker 507 and contact chime elements 507. In this manner, a remote input or event may be detected by sensor 503 for activating wind chime unit 501 to output a wind chime sound.

In one form, remote event detector 502 may be provided in association with a door bell button or ringer. For example, when a user activates a doorbell requesting entrance to a building, sensor 503 detects the input and remote event detector 502 communicates a signal to wind chime unit 501 to output a wind chime sound alerting an occupant that a visitor has arrived. In another form, remote event detector 502 may be placed near a door or an opening of a building to and sensor 503 detects if a person or object passes enters a door or opening. When sensor 503 senses movement, remote event detector 502 communicates a signal to wind chime unit 501 to output a wind chime sound.

In one embodiment, remote event detector 502 communicates information about an event to wind chime unit 501 using a wireless network 504 such as radio link or wireless home network. Such wireless links or networks may include WiFi networks, 802,11-based networks, Bluetooth networks, or various other types of networks that may be operable to communicate information about an event detected by sensor 503. In other embodiments, communication link 504 may be a wired network such as an Ethernet, LAN, etc. Remote event detector 502 may also be connected using a wired electrical connection such as twisted pair.

During operation, when wind chime unit 501 receives event information from remote event detector 502, wind chime unit 501 processes the message and outputs a sound in response to the event detected. For example, remote event detector 502 may be provided having a wind sensor as sensor 503. When wind sensor 503 senses wind, remote event detector 502 transmits a message to wind chime unit 501 and wind chime unit 501 may produce a wind chime sound in response to the wind detected. For example, if a large gust of wind is detected, sensor unit 502 may communicate a message that provides a reference to wind speed. Wind chime unit 501 may then activate electromagnet activator region 509 to produce a larger magnetic output thereby causing striker activator 508 to move striker 507 with a larger force to produce a louder chime sound such as a large gust of wind would produce when a conventional wind chime is used. In another embodiment, remote event detector 502 having sensor 503 operable to detect wind may communicate a message having a period of time when a wind has blown and communicate a message to wind chime unit 501 to output a wind chime sound for the period of time wind was detected by sensor 503.

Figure 6:
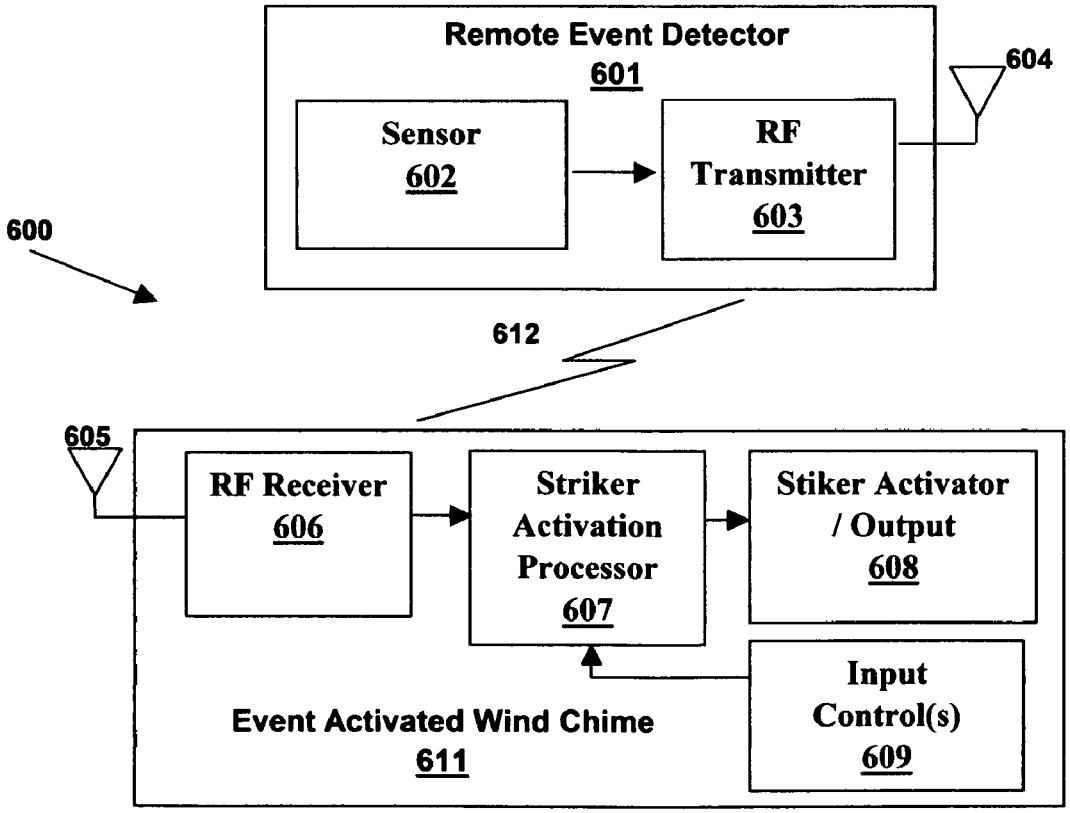
FIG. 6 illustrates a functional block diagram of a remote activated wind chime system according to one aspect of the invention.

FIG. 6 illustrates a functional block diagram of a remote activated wind chime system according to one aspect of the invention. A block diagram of a remote activated wind chime system, illustrated generally at 600, includes a remote event detector 601 including a sensor 602 such as a motion sensor. Remote event detector 601 further includes an RF transmitter 603 operable to transmit a signal using antenna 604 upon detecting an event. For example, when sensor 602 senses an event, RF transmitter 603 transmits a signal indicating that the event has been detected.

Remote activated wind chime system 600 further includes an event activated wind chime unit 611 having an RF receiver 606 and antenna 605. Remote activated wind chime system 600 further includes a striker activation processor 607, input control(s) 609, striker activator/output 608. Input control(s) may includes various types of inputs including selectors 110, 111, and 112 illustrated in FIG. 1. Striker activation processor 607 further includes complementary logic for processing inputs from input control(s) and RF receiver 606 to determine an appropriate output signal for striker activator/output 608. Activation processor 607 may include a microcontroller with input/output ports, and a timer such as a Microchip® mircocontroller having part number PIC12F508. Various forms of outputs may be provided to produce a wind chime sound including, but not limited to, activating an electromagnetic striker, an electric motor, an electric fan located proximal to a wind chime assembly, an electric fan provided as a part of a striker such as striker activator 1000 or 1015 illustrated in FIGS. 10A and 10B, or any other type of activator device operable to produce a wind chime sound using a wind chime assembly in the absence of wind. As such, event activated wind chime 611 is well suited for use internal to a building where wind is typically unavailable for activating a wind chime assembly to produce a wind chime sound.

During operation, RF receiver 606 receives event information from remote event detector 601 and transmits event information via communication medium 612 to RF receiver 606 of event activated wind chime 611. RF receiver 606 provides a decoded signal to striker activation processor 607 which processes the event information using input from input control(s) 609 and any other parameters that may be predetermined or preprogrammed as a part of event activated wind chime 611. Striker activation processor 607 produces an appropriate output signal for striker activator/output 608. For example, if an electromagnetic wind chime is employed, striker activator/output 608 would be activated to produce a magnetic force to move a striker having a striker activator responsive to magnetic forces.

In one embodiment, remote event detector 601 and event activated wind chime 611 may use a unique identification code to discriminate radio signals. For example, if event activated wind chime system 600 is used in an environment where more than one remote detector and/or event activated wind chime are being used (i.e. an office, building, various rooms, etc), event activated wind chime 611 would only be responsive to a signal sent by a specific remote event detector 601 operable to communicate a valid identifier in association with a detected event. In one embodiment, a unique identification code may be encoded as a part of remote event detector 601 and event activated wind chime 611. However, in other embodiments, a dip-switch may be set on remote event detector 601 and/or event activated wind chime 611 to specify a valid identification code. In another embodiment, event activated wind chime 611 may be used in association with plural remote detectors having the same identification code. In this manner, event activated wind chime 611 may be activated by more than one detector. For example, several doors may include separate remote event detectors 601 and if a person enters or passes a door having a remote event detector 601, a signal is communicated to event activated wind chime 611. In another embodiment, several event activated wind chimes 611 may be used with a single remote event detector 601. For example, several event activated wind chimes 611 may be placed at various locations within a building and activated upon a single remote event detector 601 detecting an event. In this manner, several event activated wind chimes 611 may be used to alert a user at various locations within a building, home, etc.

Figure 7:
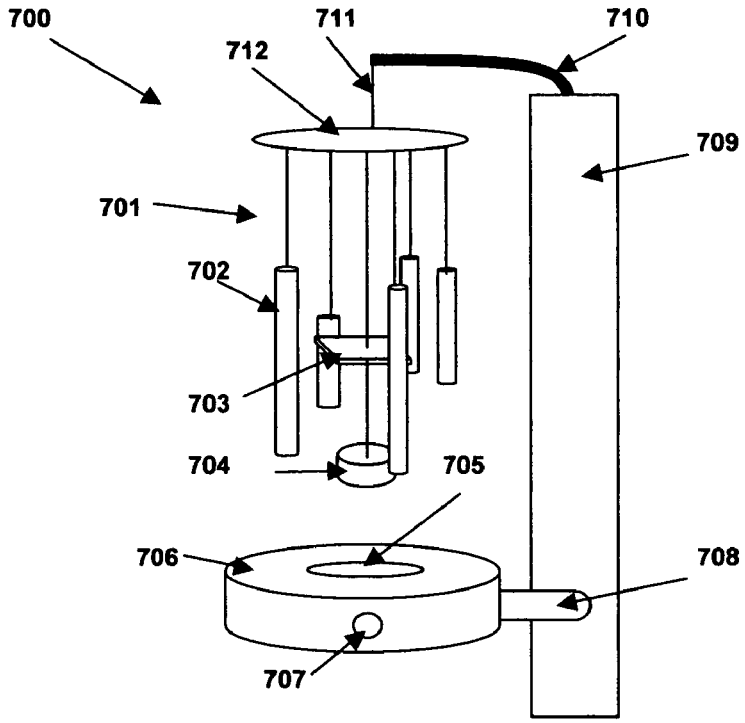
FIG. 7 illustrates an event activated wind chime system employing an independently mounted motion sensor and striker activator according to one aspect of the invention.

FIG. 7 illustrates an event activated wind chime system employing an independently mounted motion sensor and striker activator according to one aspect of the invention. An event activated wind chime system, illustrated generally at 700, include a wind chime assembly 712 having a plurality of chime elements 702 and a striker 703 proximally located to chime elements 702. A striker activator 704 is positioned below striker 703 and is operable to move striker 703 to output a wind chime sound. Wind chime assembly 712 is coupled to a mounting arm or bracket 710 for mounting to a wall or top portion of a cubed office or cubicle wall 709.

Event activated wind chime system 700 further includes a striker activation unit 706 including a motion sensor 707 and an electromagnet activation region 705 operable to be activated in response to motion sensor 707 detecting an event for outputting a wind chime sound. Striker activation unit 706 includes a wall mount 708 to connect striker activation unit 706 to wall 709. Striker activation unit 706 further includes electronics and a power source located within housing of striker activation unit 706. In other forms, an external power source may be used.

Event activated wind chime system 700 may be provided as a compact or miniature wind chime and may be well suited for use in an office or room for outputting low audio wind chime sound. Additionally, striker activation unit 706, being independently mounted from wind chime assembly 712, allows a user to move striker activation unit 706 along a vertical axis resulting in an increase or decreased magnetic force produced by electromagnet activation region 705 resulting in increased or decreased audio output levels for event activated wind chime system 700.

In another form, event activated wind chime system 700, or portions thereof, may be provided as a separate kit or add-on accessory for conventional wind chimes. For example, various portions of wind chime system 700 may be provided separately to be used with a conventional wind chime. Striker activation unit 706, striker activator 704 and wall mount 710 may be provided or sold separately and used with a conventional wind chime (not expressly shown). For example, a user may mount a conventional wind chime to a wall using wall mount 710 and couple striker activator 704 along a bottom portion of a striker called a wind catcher. A user may then place striker activator unit 706 proximal to striker activator 704 and as sensor 707 senses movement, striker activation unit 706 activates electromagnet activation region 705 causing striker activator 704 to be displaced and a striker to contact chime elements to produce a wind chime output. In this manner, various types of wind chimes may be used as desired.

Figure 8A:
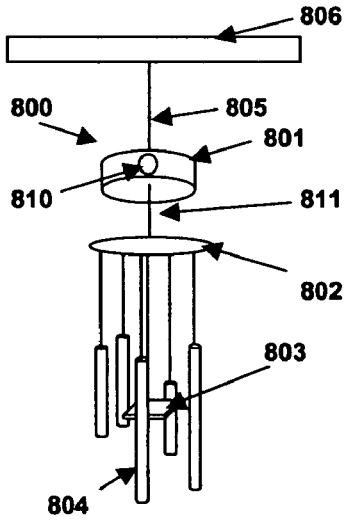
FIG. 8A illustrates an event activated wind chime system employing a wind generation unit according to one aspect of the invention.

FIG. 8A illustrates an event activated wind chime system employing a wind generation unit according to one aspect of the invention. A ceiling mounted wind chime system, illustrated generally at 800, includes a wind chime assembly 802 having a plurality of chime elements 804 and a striker 803 positioned proximal to chime elements 804. Wind chime assembly 802 is coupled to an electric motor 801 operable to move wind chimes assembly 802 to activate or move striker 803 to strike wind chime elements 804 to output a wind chime sound. Electric motor 801 may be coupled to a ceiling 806 or other form of vertical hanging or suspension structure using string or cable 805. Housing for electric motor 801 further includes a sensor 810 for sensing motion or various other events. In one form, input controls similar to input controls 110, 111, 112 of FIG. 1 may also be provided as a part of housing for electric motor 801 for controlling operation of wind chime system 800. A continuous operating mode may also be provided.

During operation, electric motor 801 moves cord or string 811 causing wind chime assembly 802 and striker 803 to be displaced resulting a wind chime sound being output. In one form, a sensor 810 may detect motion proximal to sensor 810 and activate electric motor 801 producing an output. In another form, event activated wind chime system 800 may be programmed to randomly produce an output similar to how a wind may periodically blow a conventional wind chime when used outdoors.

Figure 8B:
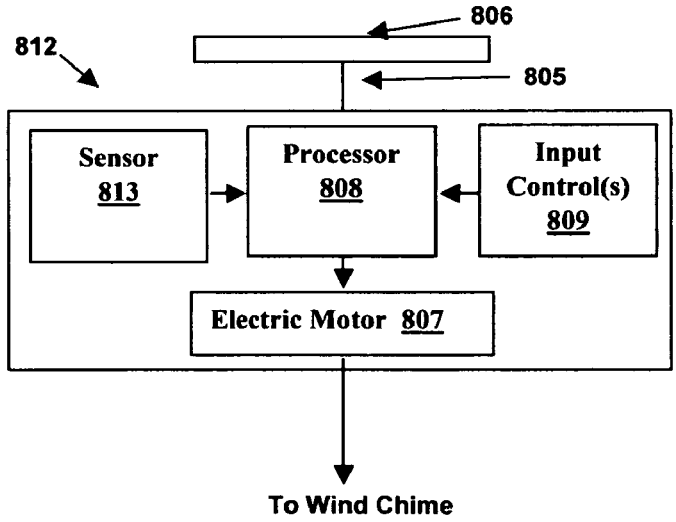
FIG. 8B illustrates a functional block diagram of an event activated wind generation unit according to one aspect of the invention.

FIG. 8B illustrates a functional block diagram of an event activated wind generation unit according to one aspect of the invention. A functional block diagram, illustrated generally at 812, includes a processor 808 coupled to input control(s) 809 operable to provide one or more inputs for controlling operating characteristics of electric motor 801. Ceiling mounted wind chime system 812 further includes a sensor 813 operable to detect motion, light, sound, etc. and provide an input to processor 808 for activating electric motor 807 to produce an output sufficient to move a portion of a wind chime to produce a wind chime sound. Other forms of an output other than a motor may be used as needed for moving a portion of wind chime including a fan, electromagnet, etc.

During operation, processor 808 generates commands for electric motor 807 based on settings provided by input control(s) 809. For example, input control(s) 809 may include a setting for a random mode that randomly moves a wind chime using output motor 807. For example, processor 808 may use a random number generator to determine a duration period for activating electric motor 807 and an interval period for deactivating electric motor 807. In another embodiment, processor 808 may be preprogrammed for a duration interval for activated electric motor 807 based on detecting an event. For example if motion is detected using motion sensor 813, motion sensor 813 provides an input to processor 808 to provide an output using electric motor 807. Processor 808 may then determine a pre-programmed activation interval and activate electric motor 807 for a specific the preprogrammed time interval.

Figure 9:
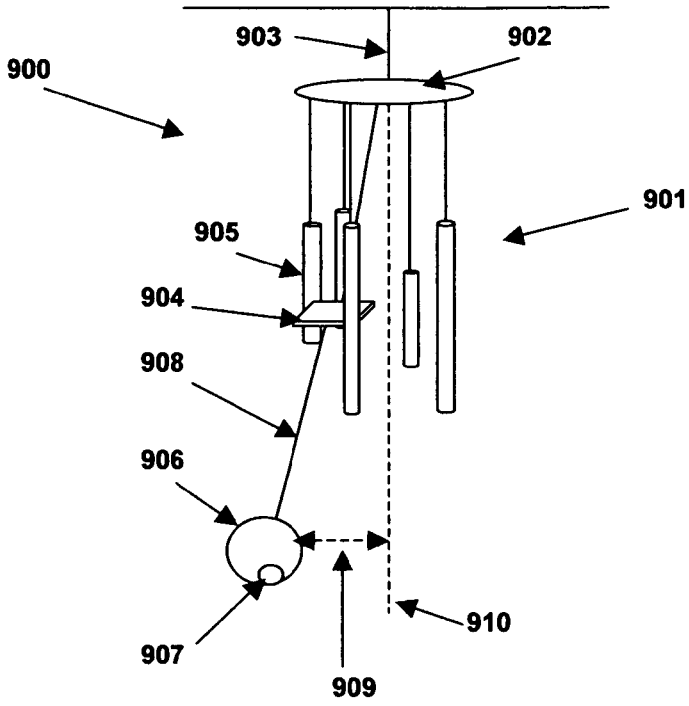
FIG. 9 illustrates an event activated wind chime system employing a fan operated wind catcher according to one aspect of the invention.

FIG. 9 illustrates an event activated wind chime system employing a fan operated wind catcher according to one aspect of the invention. Event activated wind chime system 900 includes a wind chime assembly 902 having chime elements 905 and a striker 904 placed proximal to chime elements 905 for contacting chime elements 905 to produce a wind chime sound. Event activated wind chime system 900 further includes a hanger 903 such as a string or cable 903 to couple wind chime unit 901 vertically. Event activated wind chime system 900 further includes a striker activator 906 coupled to striker 904 via cable or string 908. Striker activator 906 is formed as a wind sail similar to a conventional wind sail provided with an outdoor wind chime. Striker activator 906 generates wind using a fan 907 integrated as a part of striker activator 906. Striker activator 906 produces enough wind to move striker 904 to contact chime elements 905 to output wind chime sounds. Further details and embodiments of striker activator 906 are provided below in FIGS. 10A and 10B.

Figure 10A:
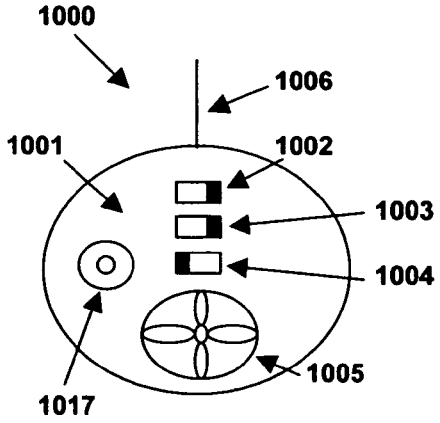
FIG. 10A illustrates a fan operated ball shaped wind sail and control circuit according to one aspect of the invention.

FIG. 10A illustrates a fan operated ball shaped wind sail and control circuit according to one aspect of the invention. A ball shaped striker activator, illustrated generally at 1000, includes a sphere shaped housing 1001 that may be formed from various types of plastics or molded materials. Ball shaped striker activator 1000 includes an electric fan 1005 and input controls 1002, 1003 and 1004 for controlling operation of ball shaped striker activator 1000. Input controls may be similar to input controls 110, 111 and 112 illustrated in FIG. 1 for controlling functionality of ball shaped striker activator 1000 to produce a wind chime sound. Ball shaped striker activator 1000 further includes a sensor 1017 operable to detect motion, light, sound, etc. and provide an input for activating electric fan 1005. Ball shaped striker activator 1000 may be battery operated and associated electronics for input controls 1002, 1003, 1004 and electric fan 1005 are housed within housing 1001. An access panel (not expressly shown) may also be provided for removing and replacing batteries as needed. Ball shaped striker activator 1000 further includes a sting or cable 1006 that may be coupled to a striker of a wind chime assembly such as wind chime assembly 902 illustrated in FIG. 9. In one form, ball shaped striker activator 1000 may be provided as a striker such as striker 904 thereby obviating the need to provide ball shaped striker activator 1000 as a separate unit coupled to striker 904 as illustrated in FIG. 9.

Figure 10B:
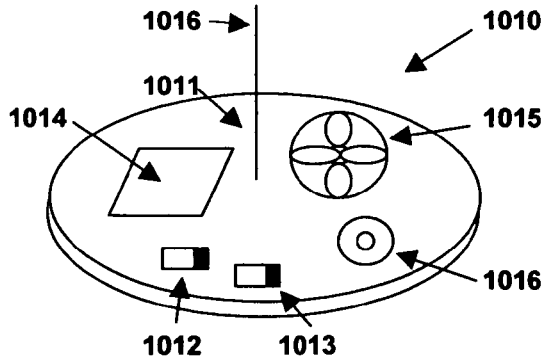
FIG. 10B illustrates a solar powered disc shaped wind sail and control circuit according to one aspect of the invention.

FIG. 10B illustrates a solar powered disc shaped wind sail and control circuit according to one aspect of the invention. A disc shaped striker activator, illustrated generally at 1010 include a disc shaped housing 1011 including an electric fan 1015 and control inputs 1012 and 1013 for controlling the operation of disc shaped striker activator 1010. Various input selectors or operating characteristics may be used by disc shaped striker activator 1010 including, but not limited to input 110, 111, and 112 illustrated in FIG. 1. Disc shaped striker activator 1010 further includes a sensor 1016 operable to detect motion, light, sound, etc. and provide an input for activating electric fan 1015. In one embodiment, disc shaped striker activator 1010 may be integrated as a part of a striker such as striker 904 illustrated in FIG. 9.

Disc shaped striker activator 1010 further includes a solar panel 1014 for converting solar energy to electrical energy for powering sensor 1016 and/or electric fan 1015. Disc shaped striker activator 1010 includes a cable or string 1016 for coupling to a striker such as striker 906 illustrated in FIG. 9. Additional power sources may also be used. For example, disc shaped striker activator 1010 may employ various forms of power sources to power disc shaped striker activator 1010. Disc shaped striker activator 1010 may use replaceable batteries and/or a solar panel 1014 to power disc shaped striker activator 1010. In one embodiment, when a solar cell 1014 is employed, activation of disc shaped striker activator 1010 may be limited by the amount of light available for converting solar energy sufficient to move disc shaped striker activator 1010. For example, disc shaped striker activator 1010 may be programmed to energize based on meeting a minimum light condition or after converting a sufficient amount of solar energy. In low light conditions, solar energy may be converted at a slower rate. As such, activation intervals and activation times may be adjusted based on the amount of available converted solar energy.

In another form, an AC adaptor may be used to power disc shaped striker activator 1010. For example, an AC adapter may be located along a ceiling or coupled to or provided in association with a wind chime assembly (not expressly shown). An AC power adapter may then convert AC power to a DC power sufficient to move disc shaped striker activator 1010 using electric fan 1015. Power provided from an AC adapter may be distributed using small diameter electrical conductors sufficient to provide power while reducing drag of movement of disc shaped striker activator 1010 caused from extra cabling.

Figure 11:
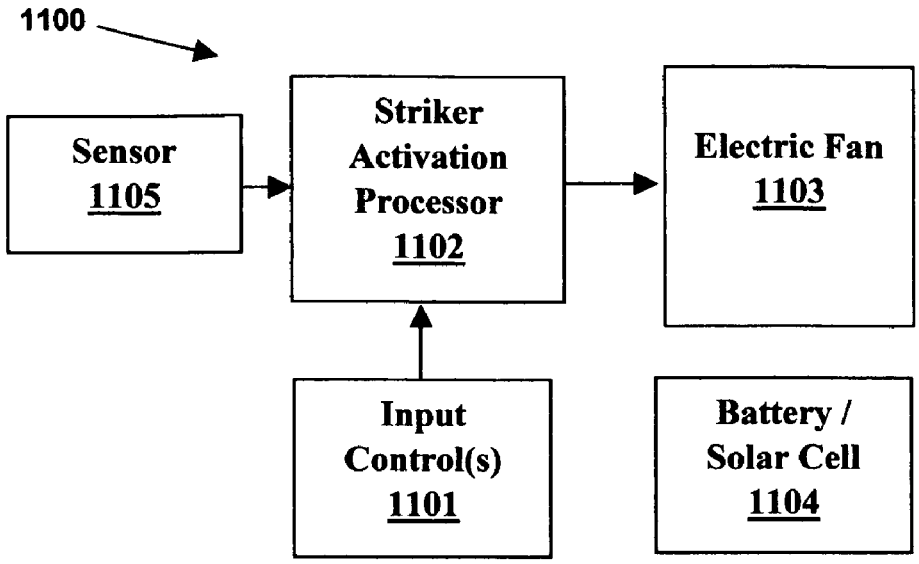
FIG. 11 illustrates a functional block diagram of an event activated wind sail according to one aspect of the invention.

FIG. 11 illustrates a functional block diagram of an event activated wind sail according to one aspect of the invention. A block diagram of an event activated wind sail, illustrated generally at 1100, includes an activation processor 1102, a sensor 1105 operable to detect motion, light, sound, etc. and provide an input for activating electric fan 1103 operable to move a wind sail for a wind chime. Event activated wind sail 1100 further includes input control(s) 1101 and a power source including a battery/solar cell 1104. Electric fan 1103 when activated provides a breeze or wind sufficient to move a striker activator and/or associated striker of a wind chime (not expressly shown). Input control(s) 1101 may be similar to input controls 110, 111, 112 of FIG. 1 and provides input to striker activation processor 1102 for controlling operating characteristics of electric fan 1103. In one form, control input(s) 1101 include a mode selection switch to allow a user to select a random or event activated operating mode. Control input(s) 1101 may also include a swing width selection switch that allows a user to select a swing width of event activated wind sail 1103. For example, a swing width may include a distance between a center-line for a striker such as centerline 910 illustrated in FIG. 9 while at rest and a distance for event activated wind sail 1100 to move when electric fan 1103 is activated. In one form, input control(s) 1101 may allow for a swing width and may be mechanically adjusted instead of electronically adjusted. Event activated wind sail 1100 may also employ one or more sensors such as a motion sensor, light sensor, etc. as sensor input to striker activation processor 1102 for controlling operating characteristics of event activated wind sail 1100.

During operation, striker activation processor 1102 determines when to energize electric fan 1103 based settings provided by input control(s) 1101 and preprogramming provided with striker activation processor 1102. For example, striker activation processor 1102 may employ a pre-programmed algorithm that includes activating electric fan 1103 at a random interval. In another form, input control(s) 1101 may be include a selector for operating wind sail striker activator 1103 based on an event. Various other operating characteristics may also be provided. Upon striker activation processor 1102 determining that electric fan 1103 should be energized, striker activation processor 1102 determines if a swing width has been provided and sufficient energy is provided to electric fan 1103 to move event activated wind sail 1100 to a desired swing width. Input control(s) 1101 may also provide an input to striker activation processor 1102 to program a length of time to provide energy to electric fan 11 03. In another embodiment, a length of time to energize electric fan 1103 may be pre-programmed.

Figure 12:
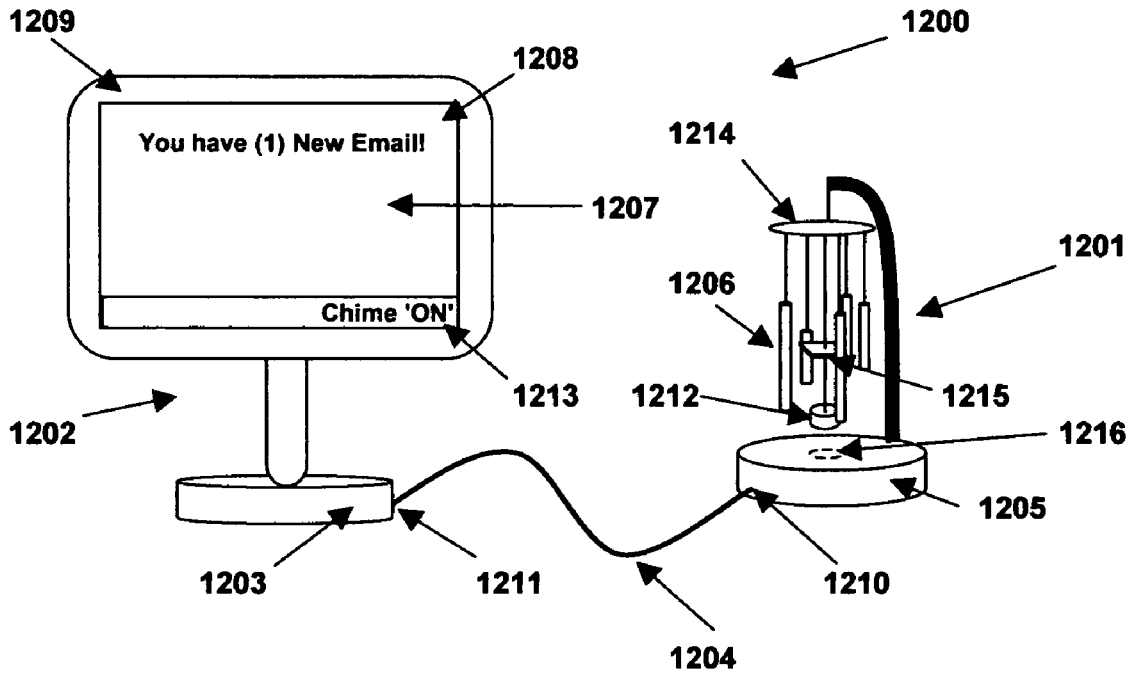
FIG. 12 illustrates a computer-enabled wind chime system operable to detect computer-based events for outputting a wind chime sound according to one aspect of the invention.

FIG. 12 illustrates a computer-enabled wind chime system operable to detect computer-based events for outputting a wind chime sound according to one aspect of the invention. A wind chime system for use with a computer system, illustrated generally at 1200, includes a computer enabled wind chime 1201 having a base 1205 and a hanger or wind chime support 1201 for suspending a wind chime assembly 1214. Wind chime assembly 1214 includes a plurality of chime elements 1206 and a striker 1215 and striker activator 1212 approximately centered to chime elements 1206. Striker activator 1212 includes a magnetic material responsive to an electromagnetic activation region 1216 provided by an electromagnet housed within base 1205. Electromagnetic activation region 1216 and striker activator 1212 cooperate to displace striker 1215 when electromagnet activation region 1216 is activate.

Base 1205 further includes an interface 1210, such as a Universal Serial Bus (USB) interface, for connecting computer enabled wind chime 1201 to a computer system 1202 using a cable 1204. Computer enabled wind chime system 1201 may be powered in various ways including using batteries, an AC adapter, or interface 1210 operable to receive power provided via cable 1204. Other interfaces may also be employed for connecting computer enabled wind chime 1201 including various wireless interfaces such as an infrared interface, a Bluetooth interface, a WiFi interface, or various other interfaces that may be used to connect a peripheral device to computer system. Computer system 1202 further includes a display 1209 such as flat panel display supported by a base 1203 having computer interface 1211. Computer enabled wind chime 1201 may be connected via cable 1204 and computer interface 1211 to computer system 1202. In one embodiment, power may be provided from computer system 1202 through interface 1211 and cable 1204 sufficient to power computer enabled wind chime 1201. Computer system 1202 further includes a graphical user interface 1207 displayed by display 1209 for displaying various types of graphical user interfaces provided by one or more programs employed by computer system 1202. For example, computer system 1202 may employ various types of operating systems including Microsoft Windows or Macintosh OS systems. Other operating systems may also be used.

During operation, as computer system 1202 initializes, computer system 1202 may detect that computer enabled wind chime 1201 is connected and an icon or graphic text 1213 may be provided indicating that computer enabled wind chime 1201 is connected. In another embodiment, computer enabled wind chime 1201 may be connected after computer system 1202 is initialized and computer system 1202 may detect when computer enabled wind chime 1201 is connected. Computer system 1202 may then detect one or more events for activating computer enabled wind chime 1201. For example, computer system 1202 may detect when a new email has arrived and display a message 1208. If computer enabled wind chime 1201 is on, computer system 1202 communicates a signal via cable 1204 to computer enabled wind chime 1201 to activate electromagnetic activation region 1216 to move striker activator 1212 and striker 1215 to produce a wind chime sound in response to receiving a new email. In another embodiment, computer system 1202 may monitor a scheduler provided in association with computer system 1202. When a scheduled event is determined, computer system 1202 may output a signal to computer enabled wind chime 1201 and output a wind chime sound accordingly. Other computer based events may also be programmed and monitored. In one embodiment, computer enabled wind chime 1201 may include a light indicator (not expressly shown) operable to illuminate in addition to outputting a wind chime sound. For example, as an event is detected, a wind chime sound may be output by computer enabled wind chime 1201 and an illuminator may be illuminated. If the event is acknowledged, modified, altered, etc. using computer system 1202, the illuminator may be extinguished. For example, if a user has a reminder programmed for a specific time and an alarm is output by computer system 1202, computer enabled wind chime 1201 may output a wind chime sound for a brief period of time and illuminate a light until a user acknowledges the reminder using computer system 1202. The illuminator provided in association with computer enabled wind chime 1201 would then be extinguished based on computer system 1202 sending a message to computer enabled wind chime 1201 that the event has been acknowledged.

In one embodiment, software for operating computer enabled wind chime 1201 may be provided by computer enabled wind chime 1201 when computer enable wind chime 1201 is connected to computer system 1202. For example, a software driver may be stored within memory (not expressly shown) of computer enabled wind chime 1201. When computer enabled wind chime 1201 is connected to a computer system for the first time, a user is prompted to allow computer enabled wind chime 1201 to install a driver onto the computer system. In another embodiment, a user may also access a website to download software to computer system 1202 as needed.

Figure 13:
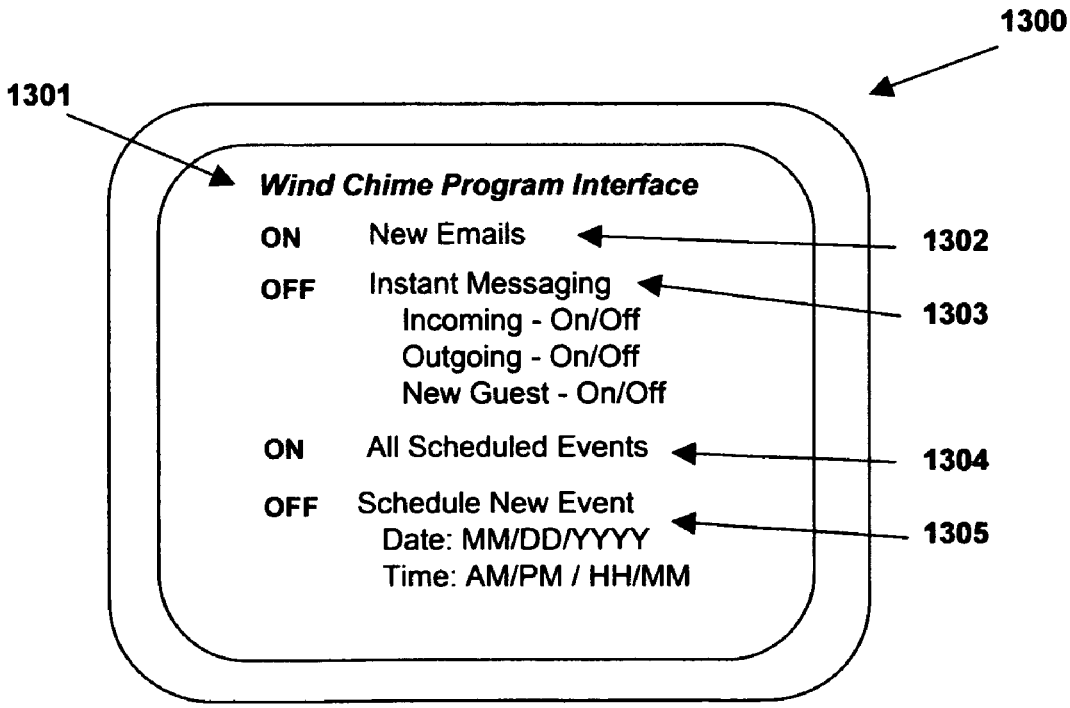
FIG. 13 illustrates a graphical user-interface for programming events for outputting a wind chime sound using a computer-enabled wind chime system according to one aspect of the invention.

FIG. 13 illustrates a graphical user interface for programming events for outputting a wind chime sound using a computer-enabled wind chime system according to one aspect of the invention. A wind chime program interface, illustrated generally at 1300, includes a wind chime program interface window 1301 and various programmable events for activating a computer enabled wind chime such as computer enabled wind chime 1201 illustrated in FIG. 12. Wind chime program interface window 1301 includes an email selector 1302 operable to enable a computer based wind chime to be activated when an email is received. Wind chime program interface window 1301 further includes an instant messaging selector 1303 to allow a user to output a signal if an incoming or outgoing instant message is detected. A user may also activate a wind chime when a guest is requesting access to a chat room (i.e. instead of or in addition to a 'knocking' sound). Wind chime program interface window 1301 further includes a selector to allow a user to enable a computer enabled wind chime for all scheduled events 1304 and further allows a user to schedule a wind chime sound at a specific time allowing a user to schedule a new event 1305.

In one embodiment, a user may access a control panel of a computer system to associate one or more program events to provide a signal to a computer enabled wind chime to activate a wind chime in association with a specific program event. For example, a Windows OS or MAC OS control panel may be accessed to associate events to provide a signal to a computer enabled wind chime instead of, or in addition to, accessing wind chime program interface 1301. For example, events such as a Windows start-up, network meetings when people join, leave, incoming calls, or various other programmable events that may be accessed using a control panel of a computer system.

Note that although an embodiment of the invention has been shown and described in detail herein, along with certain variants thereof, many other varied embodiments that incorporate the teachings of the invention may be easily constructed by those skilled in the art. Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. Accordingly, the invention is not intended to be limited to the specific form set forth herein, but on the contrary, it is intended to cover such alternatives, modifications, and equivalents, as can be reasonably included within the spirit and scope of the invention.

What is claimed is:

1. An event activated wind chime system comprising:

a wind chime assembly including at least one wind chime element proximally located to a striker operable to contact the wind chime element to output a wind chime sound; and a motion detector operably coupled to a striker activation processor provided in association with the striker, the motion event detector operable to detect a motion and provide an input to the striker activation processor to produce the wind chime sound using the striker in response to the motion.

2. The system of claim 1, further comprising a control circuit including a plurality of programmable input switches to control operating characteristics of the striker.

3. The system of claim 1 further comprising a programmable activation period operable to provide a duration period to strike the wind chime element using the striker.

4. The system of claim 2 wherein the plurality of programmable input switches includes a programmable random operating mode switch operable to enable either a random operating mode or an event operating mode.

5. The system of claim 1 further comprising the striker activation processor operable to disable activation of the striker for a predetermined time period, the striker activation processor operable to enable activation after expiration of the predetermined period and in response to detecting a second motion.

6. The system of claim 1, wherein the motion detector comprises a remote motion detector.

7. The system of claim 6 wherein the remote motion detector is operable to communicate detecting the event to the striker activation processor via a wireless medium.

8. An event activated wind chime system comprising:

a wind chime assembly including at least one wind chime element proximally located to a striker operable to contact the at least one wind chime element to output a wind chime sound;

a striker activation processor mounted independent of the wind chime assembly at a distance from the striker and coupled to a control circuit operable to control an output of the striker activation processor to produce an output sufficient to move the striker to contact the at least one wind chime element;

a motion detector operably associated with the striker activation processor, the event detector operable to detect motion and provide an input to the striker activation processor in response to motion to produce the wind chime sound; and, an input range switch operable to vary a detection range of the motion detector.

9. The system of claim 8, further comprising the striker activation processor operable to activate an electromagnetic device.

10. The system of claim 8, further comprising the striker activation processor operable to provide an output to the striker after expiration of an activation timer associated with the striker activation processor and in response to detecting a second event.

11. The system of claim 8, wherein the striker activation processor comprises a wind generator operable to provide a wind to produce the wind chime sound.

12. The system of claim 8, further comprising a rotational motor coupled to the wind chime assembly and operable to rotate the wind chime assembly to produce the wind chime sound.

13. The system of claim 8, further comprising a light sensor operable to enable and disable providing the output in response to detecting light.

14. A motion activated wind chime system comprising:

a wind chime assembly including at least one wind chime element proximally located to a striker operable to contact the at least one wind chime element to output a wind chime sound; and a motion detector operably associated with a striker activation processor coupled to a control circuit operable to provide a motion detection interval and a range detection distance, the motion detector operable to detect motion based on the range detection distance and provide an input to the striker activation processor to produce the wind chime sound based on the motion detection interval.

15. An event activated wind chime system comprising:

a wind chime assembly including at least one wind chime element proximally located to a striker operable to contact the wind chime element to output a wind chime sound; and a remote event detector operably coupled to a striker activation processor provided in association with the striker, the remote event detector operable to detect an event and provide an input to the striker activation processor to produce the wind chime sound using the striker in response to the event.

16. The system of claim 15, wherein the remote event detector operably communicates detecting the event to the striker activation processor via a wireless medium.

17. The system of claim 15, further comprising the striker activation processor operable to move the striker is selected from the group of an electromagnetic means, an electric motor means, and an electric fan means.

18. The system of claim 15 further comprising the striker activation processor mounted independent of the wind chime assembly at a distance from the striker sufficient to move the striker to contact the at least one wind chime element.

19. The system of claim 15, further comprising the striker activation processor operable to provide an output to the striker after expiration of an activation timer associated with the striker activation processor and in response to detecting a second event.

20. An event activated wind chime system comprising:

a wind chime assembly including at least one wind chime element proximally located to a striker operable to contact the wind chime element to output a wind chime sound;

a computer-based event detector operably coupled to a striker activation processor provided in association with the striker, the computer-based event detector operable to detect a computer-based event and provide an input to the striker activation processor to produce the wind chime sound using the striker in response to the computer-based event; and a universal serial bus interface operable to receive a signal in response to detecting the computer-based event.

21. The system of claim 20 wherein the striker activation processor produces an output sufficient to move the striker to contact the at least one wind chime element.

22. The system of claim 21, further comprising a light sensor operable to enable and disable the output in response to detecting light.

23. The system of claim 20, wherein the striker activation processor comprises a wind generator operable to provide a wind to produce the wind chime sound.

24. The system of claim 20 further comprising a software driver for operating the event activated wind chime system.

25. The system of claim 20 wherein a graphical user interface is provided for programming events for outputting a wind chime sound, the graphical user interface allows a user to selectively enable the event activated wind chime system in association with a plurality of computer-based events.

26. An event activated wind chime system comprising:

a wind chime assembly including at least one wind chime element proximally located to a striker operable to contact the wind chime element to output a wind chime sound;

a computer-based event detect operably coupled to a striker activation processor provided in association with the striker, the computer-based event detector operable to detect a computer-based event and provide an input to the striker activation processor to produce the wind chime sound using the striker in response to the computer-based event;

a wireless enabled event detector operable to wirelessly communicate a wireless signal to the wind chime in response to the computer-based event; and a receiver operable to receive the wireless signal to produce the wind chime sound in response to the wireless signal.

27. The system of claim 26, further comprising a rotational motor coupled to the wind chime assembly and operable to rotate the wind chime assembly to produce the wind chime sound.

28. The system of claim 26, further comprising a control circuit including a plurality of programmable input switches to control operating characteristics of the striker.

29. The system of claim 26 further comprising a programmable activation period operable to provide a duration period to strike the wind chime element using the striker.

30. The system of claim 26 further comprising a software driver for operating the event activated wind chime system.

31. The system of claim 26 wherein a graphical user interface is provided for programming events for outputting a wind chime sound, the graphical user interface allows a user to selectively enable the event activated wind chime system in association with a plurality of computer-based events.

* * * * *